US010149591B2

(12) United States Patent
Hagen

(10) Patent No.: US 10,149,591 B2
(45) Date of Patent: Dec. 11, 2018

(54) CLEANING MITT, CLEANING KIT, AND CLEANING METHOD FOR PROTECTING A USER'S HAND DURING CLEANING

(71) Applicant: Joseph P. Hagen, Lorton, VA (US)

(72) Inventor: Joseph P. Hagen, Lorton, VA (US)

( * ) Notice: Subject to any disclaimer, the term of this patent is extended or adjusted under 35 U.S.C. 154(b) by 61 days.

(21) Appl. No.: 15/405,578

(22) Filed: Jan. 13, 2017

(65) Prior Publication Data

US 2017/0202422 A1 Jul. 20, 2017

Related U.S. Application Data

(60) Provisional application No. 62/278,565, filed on Jan. 14, 2016.

(51) Int. Cl.

| | |
|---|---|
| ***A47L 13/18*** | (2006.01) |
| ***A47L 13/19*** | (2006.01) |
| ***A41D 19/01*** | (2006.01) |
| ***A41D 19/02*** | (2006.01) |
| ***A41D 19/00*** | (2006.01) |

(52) U.S. Cl.

CPC ..... *A47L 13/19* (2013.01); *A41D 19/0003* (2013.01); *A41D 19/0075* (2013.01); *A41D 19/01* (2013.01); *A41D 19/02* (2013.01); *A47L 13/18* (2013.01)

(58) Field of Classification Search

CPC ..... A47L 13/18; A47L 13/19; A47K 7/02; A47K 7/03; A41D 19/00; A41D 19/0003; A41D 19/01; A41D 19/001; A41D 19/0075; A41D 19/02

USPC ..... 15/104.94, 227; 2/158, 159, 161.6, 169

See application file for complete search history.

(56) References Cited

U.S. PATENT DOCUMENTS

| | | | | |
|---|---|---|---|---|
| 1,782,502 | A * | 11/1930 | Crane | A47L 13/18 15/227 |
| 2,880,436 | A * | 4/1959 | Hayden | A47K 7/02 15/118 |
| 4,677,697 | A | 7/1987 | Hayes | |
| 4,788,733 | A | 12/1988 | Lerner | |
| 4,902,283 | A | 2/1990 | Rojko et al. | |

(Continued)

FOREIGN PATENT DOCUMENTS

| | | | |
|---|---|---|---|
| FR | 2170999 | * | 9/1973 |
| JP | 2013-72152 | * | 4/2013 |

(Continued)

*Primary Examiner* — Mark Spisich

(74) *Attorney, Agent, or Firm* — Carter, Deluca, Farrell & Schmidt, LLP

(57) ABSTRACT

A cleaning mitt includes a base layer, a cleaning cloth layer, and a cover layer. The base layer has first and second portions interconnected by a connector. The first and second portions are folded and sealed to define a shell having an open proximal end and an interior pocket. The shell defines a palm section, a fingers section extending distally from the palm section, and first and second thumb sections extending from opposed sides of the palm section. The connector is disposed within the interior pocket. The cleaning cloth layer has a cleaning solution disposed thereon and/or therein, is secured to an outer surface of the shell, and extends about a portion of the palm section and fingers section of the shell. The cover layer is removably disposed about the cleaning cloth layer and secured to the outer surface of the shell about a portion of the cleaning cloth layer.

16 Claims, 6 Drawing Sheets

(56) References Cited

U.S. PATENT DOCUMENTS

| | | | | |
|---|---|---|---|---|
| 4,959,881 | A | 10/1990 | Murray | |
| 5,473,789 | A | 12/1995 | Oster | |
| 7,681,250 | B2 * | 3/2010 | Friedstrom ..... | A47K 7/02 15/227 |
| 2008/0016601 | A1 | 1/2008 | McCrorey et al. | |

FOREIGN PATENT DOCUMENTS

| | | | |
|---|---|---|---|
| WO | 90/07297 | * | 7/1990 |
| WO | 00/40372 | * | 7/2000 |

* cited by examiner

CLEANING MITT, CLEANING KIT, AND CLEANING METHOD FOR PROTECTING A USER'S HAND DURING CLEANING

CROSS-REFERENCE TO RELATED APPLICATIONS

This application claims the benefit of U.S. Provisional Patent Application No. 62/278,565, filed on Jan. 14, 2016, then entire contents of which are hereby incorporated herein by reference.

BACKGROUND

Technical Field

The present disclosure relates to cleaning products and, more particularly, to an ultra-portable, disposable, all-in-one cleaning mitt, cleaning kit, and cleaning method for protecting a user's hand from dirt, fluids, debris, bacteria, viruses, cleaning solutions, chemicals, and the like before, during, and after cleaning.

Background of Related Art

Cleaning products such as sanitary wipes, sponges, brushes, and the like are widely utilized in homes, businesses, and public areas to rid surfaces of dirt, fluids, debris, bacteria, viruses, etc. For example, it is often desirable to clean public restroom toilet seats, public baby changing tables, tabletops and counters at eating establishments, etc., prior to use. Many current cleaning products, although effective in cleaning the desired surface, may leave the user's hand exposed to dirt, fluids, debris, bacteria, viruses, etc. before, during, and/or after use of the cleaning product, thus presenting a risk to the user. In general, the more protective the cleaning product, the more expensive and less portable the cleaning product.

Protective gloves are commonly used, in conjunction with cleaning products, to protect the user's hand during cleaning. However, a user's hand may still be exposed to dirt, fluids, debris, bacteria, viruses, etc. during removal of the protective gloves after cleaning. Further, typical protective gloves are large and bulky, and require the user to carry around such gloves in addition to the actual cleaning product(s) to be used, thus adding expense and taking away from portability.

Accordingly, there is a need for an ultra-portable, disposable, all-in-one cleaning apparatus and methods that enable a user to clean dirt, fluids, debris, bacteria, viruses, etc. from surfaces while protecting the user's hand before, during, and after cleaning.

SUMMARY

The present disclosure relates generally to an ultra-portable, disposable, all-in-one cleaning mitt, kit incorporating plural cleaning mitts, and method of using the same. The mitt, kit, and method enable a user to clean dirt, fluids, debris, bacteria, viruses, etc. from surfaces while protecting the user's hand before, during, and after cleaning. To the extent consistent, any of the aspects and features of the present disclosure detailed hereinbelow may be used in conjunction with any or all of the other aspects and features of the present disclosure detailed hereinbelow. Further, in addition to, and distinct from functional aspects and features, the present disclosure also provides an ornamental design for a cleaning mitt, as detailed and illustrated herein.

Provided in accordance with aspects of the present disclosure is a cleaning mitt including a base layer, a cleaning cloth layer, and a cover layer. The base layer has a first portion and a second portion interconnected by a connector. The first and second portions are folded on one another and sealed about portions of the peripheries thereof to define a shell having an open proximal end and an interior pocket. The shell defines a palm section, a fingers section extending distally from the palm section, and first and second thumb sections extending from opposed sides of the palm section. The connector is disposed within the interior pocket between the first and second portions. The cleaning cloth layer has a cleaning solution disposed thereon and/or therein, is secured to an outer surface of the shell, and extends about a portion of the palm section and fingers section of the shell. The cover layer is removably disposed about the cleaning cloth layer and secured to the outer surface of the shell about a portion of an outer perimeter of the cleaning cloth layer.

In aspects of the present disclosure, the base layer is formed from a single sheet of flexible plastic material.

In aspects of the present disclosure, the cleaning cloth layer is formed from a textured soft cloth paper.

In aspects of the present disclosure, the first and second portions are sealed about portions of the peripheries thereof via heat sealing.

In aspects of the present disclosure, the cleaning cloth layer is secured to the outer surface of the shell via an adhesive.

In aspects of the present disclosure, the cover layer is adhered to the outer surface of the shell.

In aspects of the present disclosure, the first and second portions of the base layer each include first and second spaced-apart proximal strips extending from the open proximal end of the shell. The first proximal strips are secured to one another and the second proximal strips secured to one another.

Also provided in accordance with the present disclosure is a kit including packaging and at least one cleaning mitt disposed within the packaging. The at least one cleaning mitt may be configured similarly as detailed above. In aspects, a plurality of cleaning mitts are provided, which may be disposed within the packaging in a stacked configuration.

A method of cleaning provided in accordance with the present disclosure includes: inserting the right or left hand into a cleaning mitt such that the palm is disposed within a palm section of the cleaning mitt, the fingers extend into a fingers section of the cleaning mitt, and the thumb is disposed in a corresponding right or left thumb section; removing a cover layer of the cleaning mitt to expose a cleaning cloth layer having a cleaning solution thereon and/or therein; cleaning a surface using the cleaning cloth layer; grasping or pinching a connector disposed within the cleaning mitt with the fingers; pulling one or both proximal strips of the cleaning mitt distally while maintaining the grasping or pinching of the connector to remove the cleaning mitt from hand while inverting the mitt to retain the cleaning cloth layer in an interior thereof; and tying off the proximal strips to enclose the cleaning cloth layer within the interior of the cleaning mitt.

In aspects of the present disclosure, the right or left have is inserted into the cleaning mitt such that the palm faces the cleaning cloth layer.

In aspects of the present disclosure, prior to inserting the right or left hand, the method further includes removing the cleaning mitt from packaging. In aspects, removing the cleaning mitt from packaging includes removing the cleaning mitt atop a stack of cleaning mitts disposed within the packaging.

BRIEF DESCRIPTION OF THE DRAWINGS

Various aspects and features of the present disclosure are described herein with reference to the drawings wherein like reference numerals identify similar or identical elements and.

DETAILED DESCRIPTION

Figure 1:
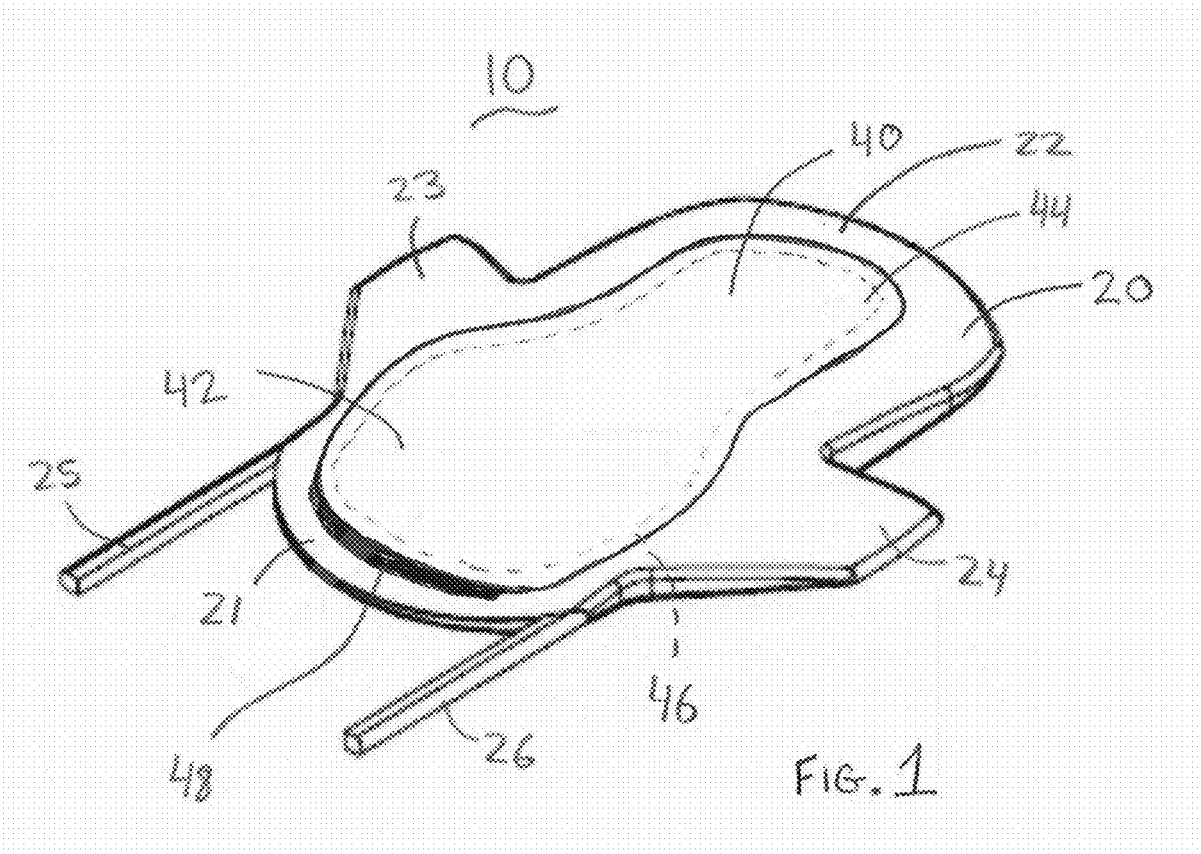
FIG. 1 is a perspective view of a cleaning mitt provided in accordance with the present disclosure.
Figure 2:
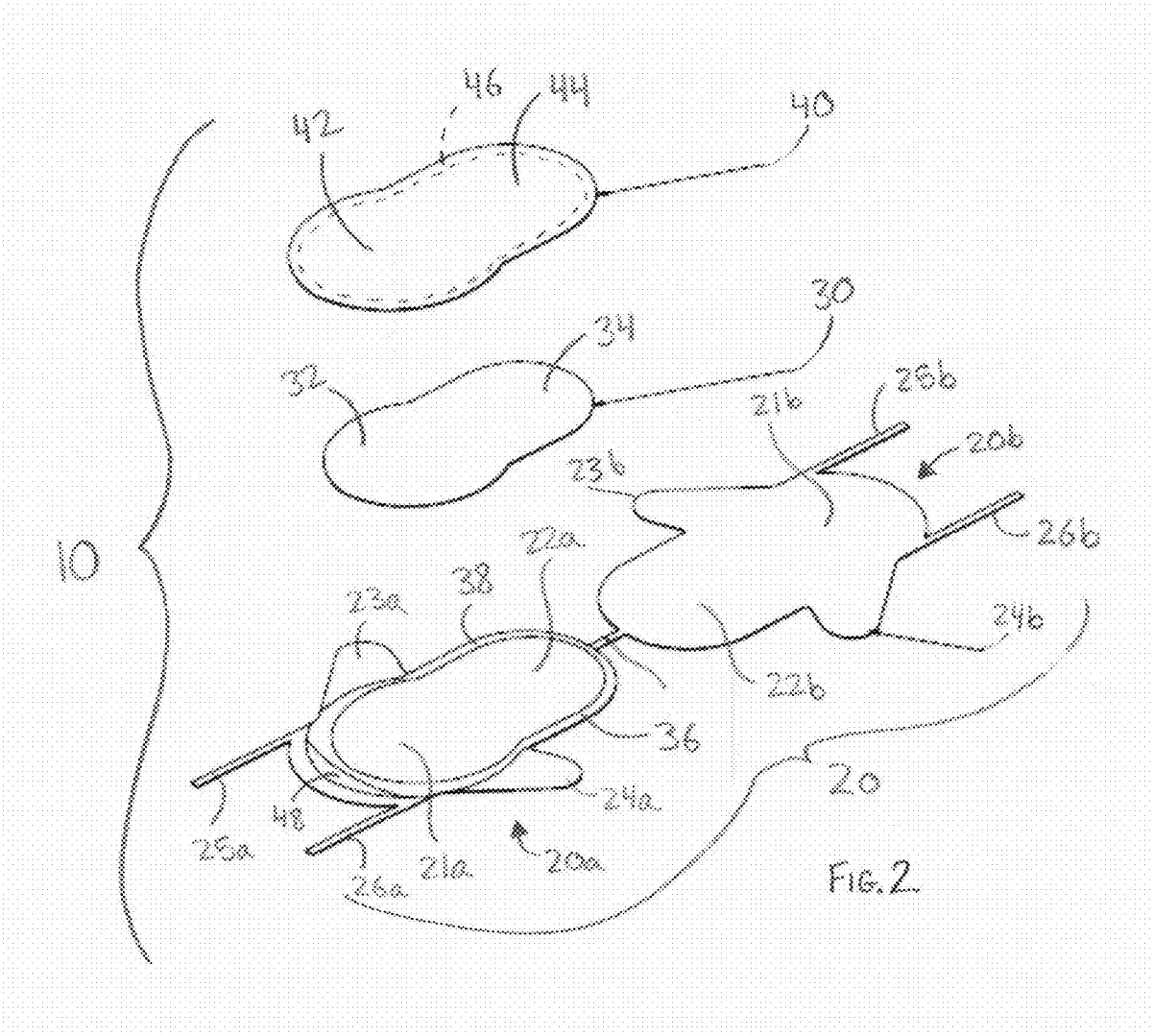
FIG. 2 is an exploded, perspective view of the cleaning mitt of FIG. 1.
Figure 3:
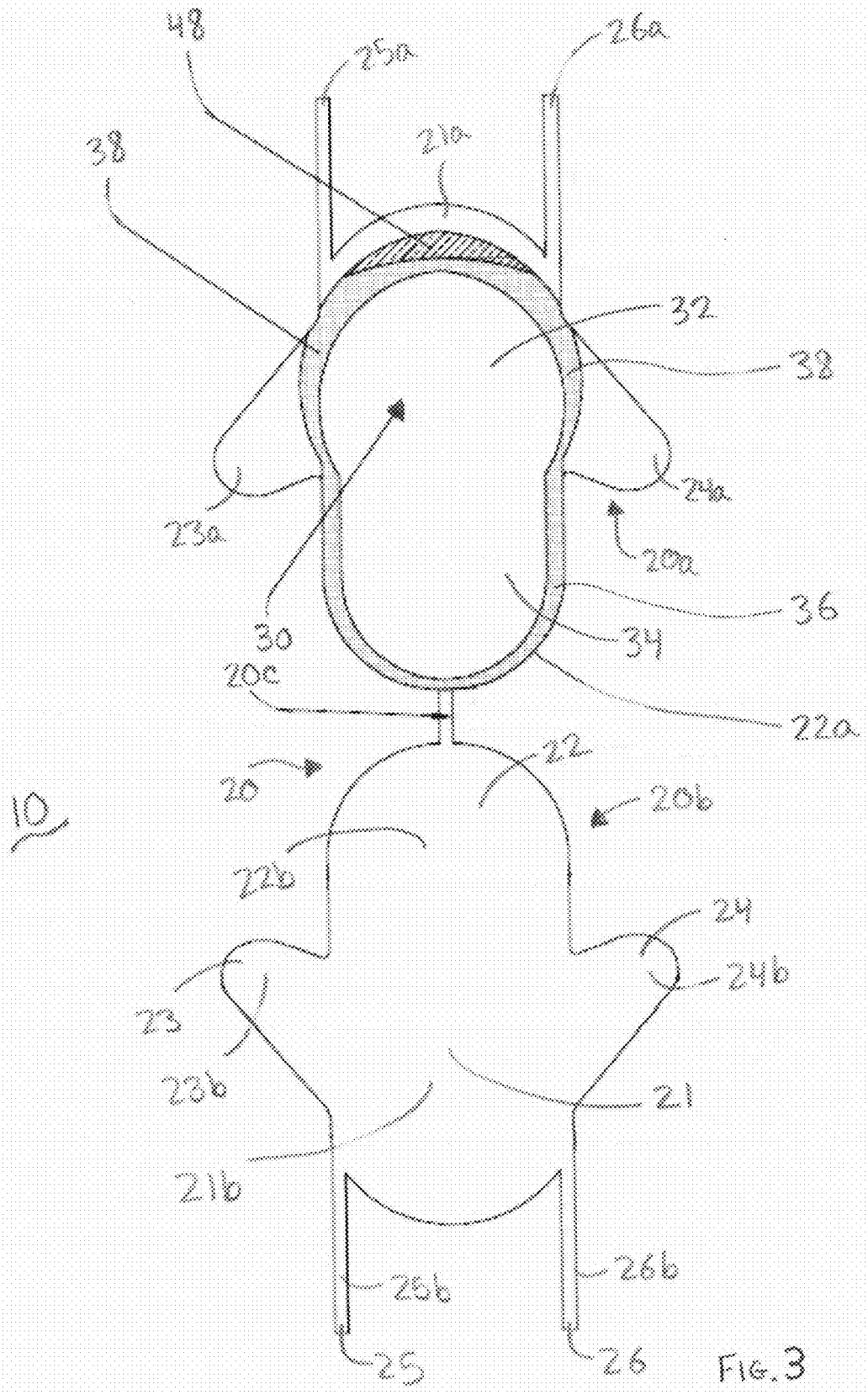
FIG. 3 is a top, partially-assembled view of the cleaning mitt of FIG. 1.
Figure 4:
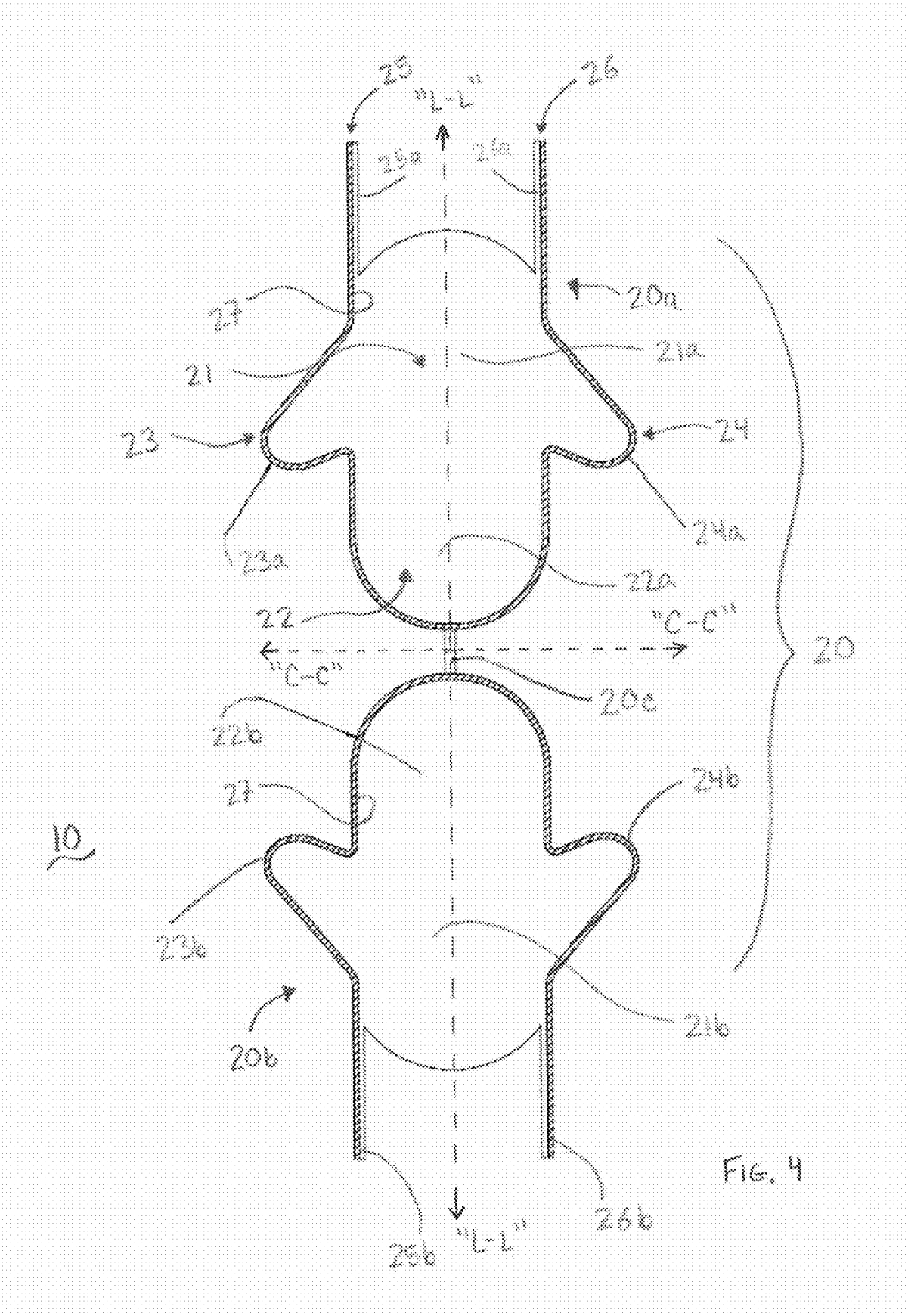
FIG. 4 is a bottom, partially-assembled view of the cleaning mitt of FIG. 1.

Referring to FIGS. 1-4, a cleaning mitt provided in accordance with the present disclosure is shown generally identified by reference numeral 10. Cleaning mitt 10 generally includes a base layer 20, a cleaning cloth layer 30, and a cover layer 40. As detailed below, cleaning mitt 10 enables a user to clean dirt, fluids, debris, bacteria, viruses, etc. from surfaces while protecting the user's hand before, during, and after cleaning.

Base layer 20 of cleaning mitt 10 is monolithically formed from a single sheet of material, e.g., a flexible plastic, and includes first and second portions 20*a*, 20*b* interconnected by a connector 20*c*. Connector 20*c* defines a central fold axis "C-C" about which first and second portions 20*a*, 20*b* are symmetric and configured to be folded to form the shell of cleaning mitt 10. Base layer 20 further defines a longitudinal axis "L-L," perpendicular to central fold axis "C-C," about which base layer 20 is symmetric.

First and second portions 20*a*, 20*b* of base layer 20 each include a palm section 21*a*, 21*b* (collectively palm section 21 of base layer 20) having a proximal end, a distal end, and opposed sides; a fingers section 22*a*, 22*b* (collectively fingers section 22 of base layer 20) extending distally from the respective palm section 21*a*, 21*b*; a pair of thumb sections 23*a*, 24*a* and 23*b*, 24*b* (collectively thumb sections 23, 24 of base layer 20) extending outwardly from the opposed sides of the respective palm section 21*a*, 21*b*; and a pair of proximal strips 25*a*, 26*a* and 25*b*, 26*b* (collectively proximal strips 25, 26 of base layer 20) extending proximally from opposed edges of the proximal surface of the respective palm section 21*a*, 21*b*.

As noted above, first and second portions 20*a*, 20*b* are configured to be folded about central fold axis "C-C" to form the shell of cleaning mitt 10. More specifically, either or both of first and second portions 20*a*, 20*b* include a sealing area 27 disposed about the outer perimeter thereof, except for at the proximal end thereof, such that, upon folding of base layer 20, the outer perimeters of first and second portions 20*a*, 20*b* are able to be sealed to one another about sealing area 27, for example, via heat sealing, although, in other embodiments an adhesive or other suitable sealing method may be utilized. Notably, the proximal ends of first and second portions 20*a*, 20*b* are not sealed to one another. Further, after or during folding of base layer 20, but prior to sealing first and second portions 20*a*, 20*b* to one another, connector 20*c* is tucked between first and second portions 20*a*, 20*b* such that, upon sealing first and second portions 20*a*, 20*b*, first and second portions 20*a*, 20*b* are sealed about connector 20*c* with connector 20*c* disposed therebetween and defining a loop or tab. The advantage of this configuration is detailed below.

As a result of the sealing of first and second portions 20*a*, 20*b* of base layer 20, as detailed above, an interior pocket having an open proximal end and the loop or tab of connector 20*c* disposed therein is formed. The open proximal end of the interior pocket of base layer 20 enables insertion of the right or left hand of a user into cleaning mitt 10 such that the user's palm is disposed within palm section 21, the user's fingers extend into fingers section 22, and the user's thumb is disposed within one of thumb sections 23, 24 (depending upon which hand is inserted into cleaning mitt 10). More specifically, by providing a thumb section 23, 24 extending from each side of palm section 21, base layer 20 define an ambidextrous configuration for use on the right or left hand of a user.

Proximal strips 25, 26, as detailed below, facilitate the removal, reversal, and disposal of cleaning mitt 10 after use. The proximal strips 25*a*, 26*a* of first portion 20*a* are sealed to respective proximal strips 25*b*, 26*b* of second portion 20*b* as part of the sealing of first and second portions 20*a*, 20*b* to one another.

Cleaning cloth layer 30 of cleaning mitt 10 is configured for positioning on the outwardly-facing surface of one of the first or second portions 20*a*, 20*b* of base layer 20, e.g., on first portion 20*a* of base layer 20, such that, upon sealing of first and second portions 20*a*, 20*b* to one another to form the shell of cleaning mitt 10, cleaning cloth layer 30 is exposed on the exterior of the shell of cleaning mitt 10. Cleaning mitt 10 is configured to receive a user's hand oriented with the user's palm facing first portion 20*a*, e.g., the portion including cleaning cloth layer 30 disposed thereon, such that cleaning mitt 10 provides, in use, a cleaning cloth layer 30 disposed on the palm-side of the user's hand, regardless of whether the left or right hand of the user is inserted into cleaning mitt 10.

Cleaning cloth layer 30 is formed from a textured soft cloth paper moistened with a cleaning solution. The cleaning solution may be an eco-friendly cleaning solution configured to cleanse and disinfect surfaces on-contact.

Cleaning cloth layer 30 may be secured to first portion 20*a* of base layer 20 using an adhesive or in any other suitable fashion. Cleaning cloth layer 30, more specifically, includes a palm section 32 that is similarly configured but smaller than palm section 21*a* of first portion 20*a* of base layer 20, and a fingers section 34 that is similarly configured but smaller than fingers section 22*a* of first portion 20*a* of base layer 20. With palm section 32 of cleaning cloth layer 30 being smaller than palm section 21*a* of first portion 20*a* of base layer 20, and with fingers section 34 of cleaning cloth layer 30 being smaller than fingers section 22*a* of first portion 20*a* of base layer 20, an exposed strip 36 of material of palm section 21*a* and fingers section 22*a* of first portion 20*a* of base layer 20 surrounds cleaning cloth layer 30. This exposed strip 36 is configured to receive an adhesive 38 except at the proximal end of palm section 21*a* of first portion 20*a* of base layer 20. The purposes of exposed strip 36 and adhesive 38 are detailed below.

Cover layer 40 of cleaning mitt 10 is configured for positioning on the outwardly-facing surface of the portion of base layer 20 having cleaning cloth layer 30 disposed thereon, e.g., first portion 20*a* of base layer 20. Cover layer 40 is configured to cover cleaning cloth layer 30 and includes a palm section 42 that is similarly configured and dimensioned as palm section 21*a* of first portion 20*a* of base layer 20, and a fingers section 44 that is similarly configured and dimensioned as fingers section 22*a* of first portion 20*a* of base layer 20.

Cover layer 40 is formed from a flexible plastic and is configured to cover cleaning cloth layer 30 such that, prior to removal of cover layer 40 for use, cleaning cloth layer 30 remains moist with the cleaning solution disposed therein and/or thereon. More specifically, with cover layer 40 including palm section 42 similarly configured and dimensioned as palm section 21*a* of first portion 20*a* of base layer 20, and fingers section 44 similarly configured and dimensioned as fingers section 22*a* of first portion 20*a* of base layer 20, an exposed strip 46 of material of palm section 42 and fingers section 44 of cover layer 40 surroundings cleaning cloth layer 30 and aligns with exposed strip 36 of material of first portion 20*a* of base layer 20. Exposed strip 46 is adhered to exposed strip 36 via adhesive 38 so as to enclose and maintain the moistness of cleaning cloth layer 30. The portion 48 of exposed strip 46 of palm section 42 of cover layer 40 that aligns with the portion of exposed strip 36 adjacent the proximal end of palm section 21*a* of first portion 20*a* of base layer 20, which does not include adhesive 38 thereon, rests atop the corresponding portion of exposed strip 36, and provides a grasping area from which the user can grasp cover layer 40 and peel cover layer 40 back to remove cover layer 40 from base layer 20, thereby exposing the moist cleaning cloth layer 30 for use.

Referring still to FIGS. 1-4, in use, a user inserts a desired hand into the interior pocket of base layer 20 with the user's palm disposed within palm section 21, the user's fingers extending into fingers section 22, and the user's thumb disposed in the appropriate thumb section 23, 24. Next, with the other hand, the user peels back the non-adhered portion 48 of cover layer 40 to remove cover layer 40 and expose the moist cleaning cloth layer 30 on the palm-side of the user's hand. At this point, cover layer 40 may be discarded. Thereafter, the user can clean the desired surface or surfaces using cleaning cloth layer 30. Cleaning mitt 10 is ergonomically configured to permit cleaning as the user would naturally, with the palm and/or fingers. As can be appreciated, dirt, fluids, debris, bacteria, viruses, etc. may be collected on cleaning cloth layer 30 during cleaning.

Once cleaning is complete, the user pinches or otherwise grasps the loop or tab of connector 20*c* between the fingers and, with the other hand, pulls one or both of proximal strips 25, 26 distally, while maintaining the pinch and/or grasp on connector 20*c*. The grasping of connector 20*c* enables the user to move proximal strips 25, 26 distally to invert cleaning mitt 10 without having cleaning mitt 10 distally-slide off the user's hand. As such, it is ensured that cleaning mitt 10 is fully inverted as it is removed, and, accordingly, that the cleaning cloth layer 30, which may include dirt, fluids, debris, bacteria, viruses, etc. thereon, is contained within the interior of the inverted cleaning mitt 10 upon removal. Finally, proximal strips 25, 26 may be tied to one another to enclose the interior of the inverted cleaning mitt 10, inhibiting contact with the cleaning cloth layer 30 during manipulation of cleaning cloth layer 30 for disposal. In instances where an appropriate disposal location is not nearby, the inverted, tied cleaning mitt 10 may be placed in the user's bag, pocket, or remain in the user's hand without the risk of contact with the cleaning cloth layer 30 since, as noted above, the cleaning cloth layer 30 is enclosed within the interior of the inverted cleaning mitt 10, tied off by proximal strips 25, 26.

Figure 5A:
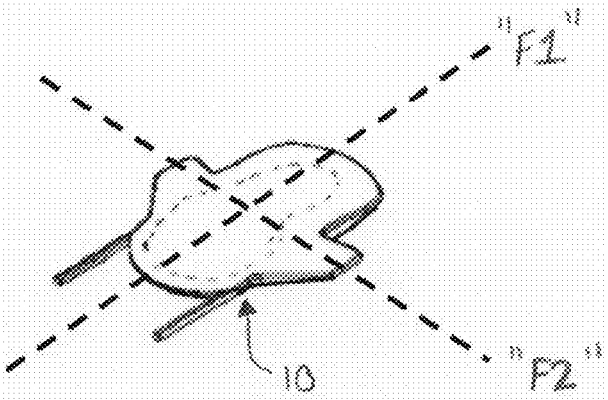
FIG. 5A is a perspective view of the cleaning mitt of FIG. 1 illustrating fold lines for folding the cleaning mitt for packaging.
Figure 5B:
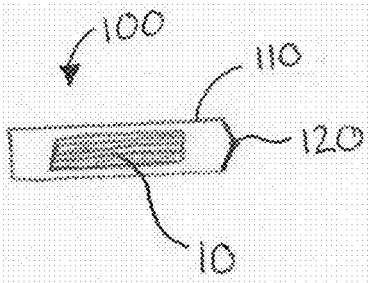
FIG. 5B is a side view of a kit including the folded cleaning mitt of FIG. 5A enclosed within resealable packaging.

Turning now to FIGS. 5A and 5B, cleaning mitt 10 may be packaged individually. More specifically, cleaning mitt 10 may be folded in quarters, as indicated by fold lines "F1" and F2" to enable cleaning mitt 10 to be inserted into a fluid-tight packaging 110 having a resealable opening 120 as part of a kit 100. As can be appreciated, with respect to kit 100, a used, inverted cleaning mitt 10 may be placed back in packaging 110 and opening 120 sealed after use, in addition to or as an alternative to tying cleaning mitt 10.

Figure 6A:
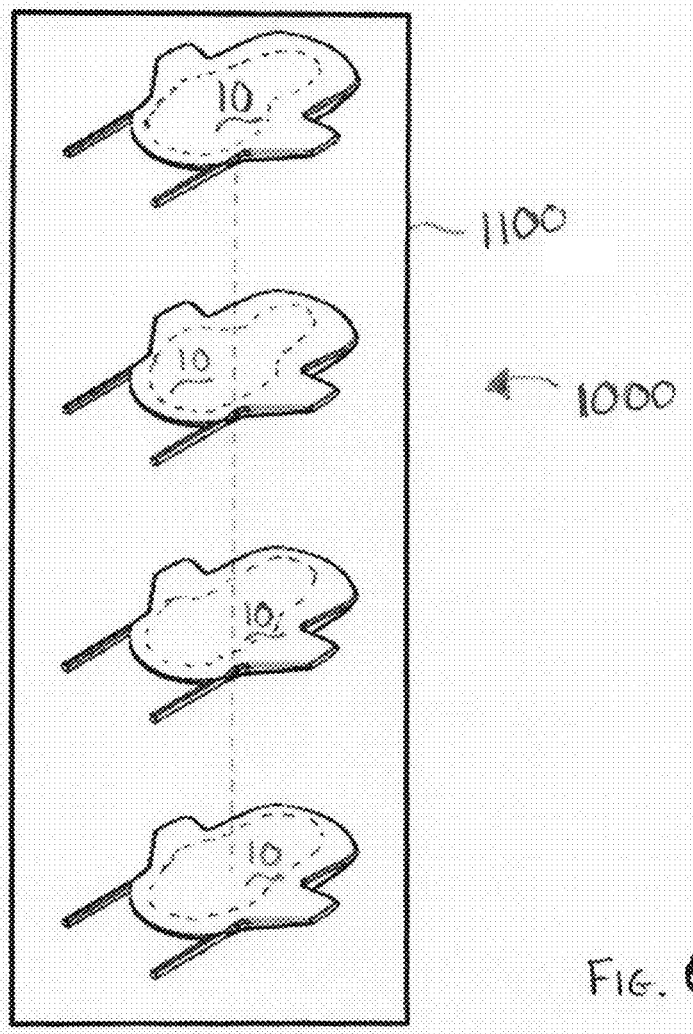
FIG. 6A is an exploded, perspective view of a kit of cleaning mitts provided in accordance with the present disclosure.
Figure 6B:
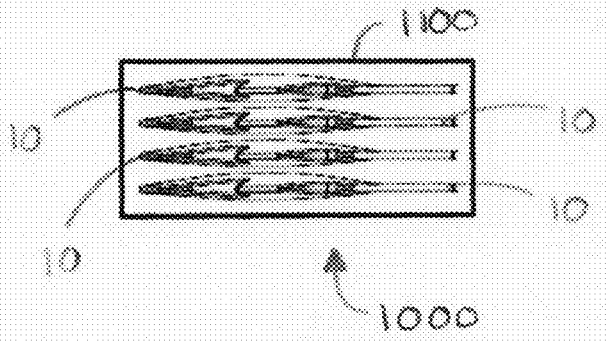
FIG. 6B is a side view of the kit of cleaning mitts of FIG. 6A.

Turning to FIGS. 6A and 6B, as an alternative to individual packaging, a kit 1000 containing plural cleaning mitts 10 may be provided. With respect to kit 1000, a suitable packaging 1100 for retaining an enabling efficient removal of each cleaning mitt 10 disposed therein in successive fashion is provided for housing plural cleaning mitts 10. Although four (4) cleaning mitts 10 are shown, it is envisioned that kit 1000 may include any suitable number of cleaning mitts 10.

From the foregoing and with reference to the various drawing figures, those skilled in the art will appreciate that certain modifications can also be made to the present disclosure without departing from the scope of the same. While exemplary embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A cleaning mitt, comprising:

a base layer having a first portion and a second portion interconnected by a connector, wherein the first and second portions are folded on one another and sealed about portions of the peripheries thereof to define a shell having an open proximal end and an interior pocket, the shell defining a palm section, a fingers section extending distally from the palm section, and first and second thumb sections extending from opposed sides of the palm section, wherein the connector is disposed within the interior pocket between the first and second portions;

a cleaning cloth layer having a cleaning solution disposed at least one of thereon or therein, the cleaning cloth layer secured to an outer surface of the shell and extending about a portion of the palm section and fingers section of the shell; and a cover layer removably disposed about the cleaning cloth layer and secured to the outer surface of the shell about a portion of an outer perimeter of the cleaning cloth layer.

2. The cleaning mitt according to claim 1, wherein the base layer is formed from a single sheet of flexible plastic material.

3. The cleaning mitt according to claim 1, wherein the cleaning cloth layer is formed from a textured soft cloth paper.

4. The cleaning mitt according to claim 1, wherein the first and second portions are sealed about portions of the peripheries thereof via heat sealing.

5. The cleaning mitt according to claim 1, wherein the cleaning cloth layer is secured to the outer surface of the shell via an adhesive.

6. The cleaning mitt according to claim 1, wherein the cover layer is adhered to the outer surface of the shell.

7. The cleaning mitt according to claim 1, wherein the first and second portions of the base layer each include first and second spaced-apart proximal strips extending from the open proximal end of the shell, the first proximal strips secured to one another and the second proximal strips secured to one another.

8. A kit, comprising:

a packaging; and at least one cleaning mitt disposed within the packaging, each of the at least one cleaning mitts comprising:

a base layer having a first portion and a second portion interconnected by a connector, wherein the first and second portions are folded on one another and sealed about portions of the peripheries thereof to define a shell having an open proximal end and an interior pocket, the shell defining a palm section, a fingers section extending distally from the palm section, and first and second thumb sections extending from opposed sides of the palm section, wherein the connector is disposed within the interior pocket between the first and second portions;

a cleaning cloth layer having a cleaning solution disposed at least one of thereon or therein, the cleaning cloth layer secured to an outer surface of the shell and extending about a portion of the palm section and fingers section of the shell; and a cover layer removably disposed about the cleaning cloth layer and secured to the outer surface of the shell about a portion of an outer perimeter of the cleaning cloth layer.

9. The kit according to claim 8, wherein the at least one cleaning mitt includes a plurality of cleaning mitts.

10. The kit according to claim 9, wherein the plurality of cleaning mitts are disposed within the packaging in a stacked configuration.

11. The kit according to claim 8, wherein the base layer of each of the at least one cleaning mitts is formed from a single sheet of flexible plastic material.

12. The kit according to claim 8, wherein the cleaning cloth layer of each of the at least one cleaning mitts is formed from a textured soft cloth paper.

13. The kit according to claim 8, wherein the first and second portions of each of the at least one cleaning mitts are sealed about portions of the peripheries thereof via heat sealing.

14. The kit according to claim 8, wherein the cleaning cloth layer of each of the at least one cleaning mitts is secured to the outer surface of the shell thereof via an adhesive.

15. The kit according to claim 8, wherein the cover layer of each of the at least one cleaning mitts is adhered to the outer surface of the shell thereof.

16. The kit according to claim 8, wherein the first and second portions of the base layer of each of the at least one cleaning mitts each include first and second spaced-apart proximal strips extending from the open proximal end of the shell thereof, the first proximal strips secured to one another and the second proximal strips secured to one another.

* * * * *